United States Patent [19]

Kihara

[11] Patent Number: 4,597,673

[45] Date of Patent: Jul. 1, 1986

[54] ANALOGUE TYPE TIMER

[75] Inventor: Hiroyuki Kihara, Tanashi, Japan

[73] Assignee: Citizen Watch Co., Ltd., Tokyo, Japan

[21] Appl. No.: 723,626

[22] Filed: Apr. 15, 1985

[30] Foreign Application Priority Data

Apr. 20, 1984 [JP] Japan ..... 59-79773

[51] Int. Cl.[4] ..... G04B 19/00; G04F 10/00

[52] U.S. Cl. ..... 368/80; 368/110

[58] Field of Search ..... 368/76, 80, 107–113, 368/223

[56] References Cited

U.S. PATENT DOCUMENTS

| | | | |
|---|---|---|---|
| 3,789,600 | 2/1974 | Champan | 368/110 |
| 4,211,066 | 7/1980 | Kusumoto et al. | 368/113 |
| 4,270,197 | 5/1981 | Minowa | 368/113 |
| 4,364,668 | 12/1982 | Gagnebin et al. | 368/80 |
| 4,364,669 | 12/1982 | Thoenig et al. | 368/111 |
| 4,494,879 | 1/1985 | Meisner | 368/76 |
| 4,526,475 | 7/1985 | Moriya | 368/80 X |

*Primary Examiner*—Vit W. Miska

*Attorney, Agent, or Firm*—Spencer & Frank

[57] ABSTRACT

An electronic watch equipped with an analogue type timer which is capable of shifting the timer from the "minute" stepping mode to the "second" stepping mode in the final part of the length of set time.

7 Claims, 3 Drawing Figures

ANALOGUE TYPE TIMER

BACKGROUND OF THE INVENTION

Field of the Invention

This invention relates to an improvement in or relating to an analogue type timer, and more particularly to a timer using a single hand for indicating time. This invention permits the increase of resolution in showing time in a selected part of time set by a single-handed timer.

Recently analogue type electronic watches which are capable of performing a variety of functions have been commercially available in the market. For instance, such a multi-function watch can be switched to an alarm mode or to a stopwatch or timer mode when desired.

There are two kinds of multi-function watches, one using a two-handed timer and the other using a single-handed timer. As for the two-handed timer, it can be set an elongated length of time with the aid of long and short hands with precision, but disadvantageously time setting requires relatively complicated operation and a remaining length of time is difficult to determine from the positions of the long and short hands with as much easiness and precision as permitted in a single-handed timer. Therefore, multi-function watches each equipped with a single-handed timer have been popular. The maximum setting time in such a single-handed is limited to the full circumference of the round numbered face of the timer, and therefore the maximum setting length of time cannot be extended without reducing the resolution of time (i.e., without increasing time per each step of the single hand). Conversely, the resolution of time cannot be improved without reducing the maximum setting time (i.e., decreasing time per each step of the single hand).

SUMMARY OF THE INVENTION

The object of this invention is to provide a watch equipped with a single-handed timer capable of being set for an increased length of time, and capable of showing time with an increased resolution for a selected part of the length of set time.

DETAILED DESCRIPTION OF A PREFERRED EMBODIMENT

As electronic watch equipped with a sigle-handed timer according to one embodiment of this invention is described below with reference to the accompanying drawings.

Figure 1:
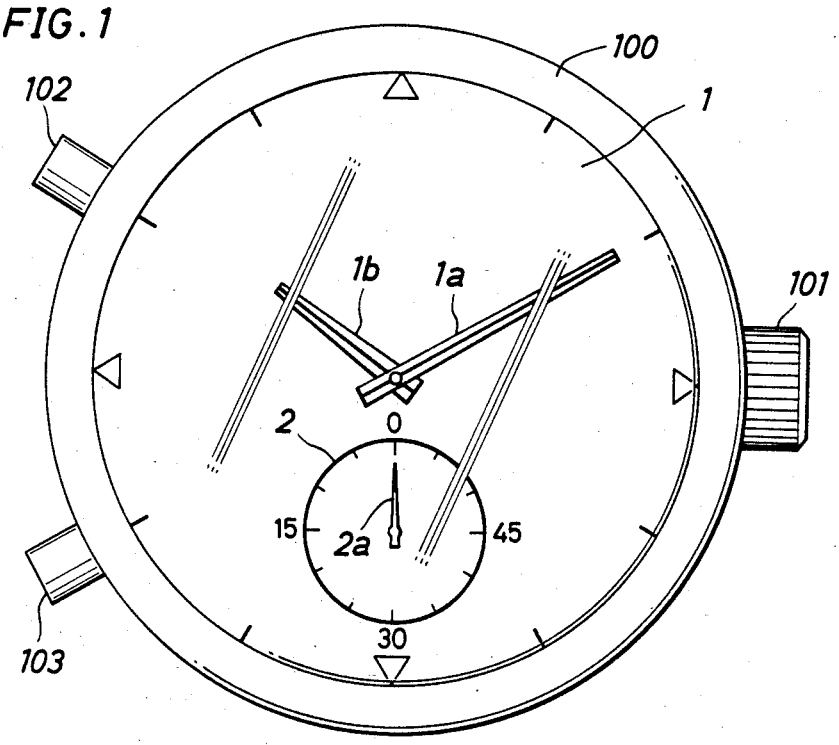
FIG. 1 shows a plan view of an electronic watch equipped with a single-handed timer.

FIG. 1 is a plan view of an electronic watch equipped with a single-handed timer to which this invention is applied to. In FIG. 1, present time is shown by means of an hour hand 1*b* and a minute hand 1*a* in the round face 1 of the electronic watch 100.

As shown, it has a stem 101 for setting time, a button 103 for setting desired time in a timer 2 (later described), and a start-and-stop button 102 (hereinafter abbreviated "SS button") provided therearound. The timer 2 has a single hand 2*a*, which moves around an indicating dial at the rate of 60 steps per revolution. A desired time can be set by means of the time setting button 103, and the start and stop of the timer can be controlled by means of the "SS button" 102. In operation, the single hand 2*a* moves clockwise at the rate of 60 steps per revolution, showing the remaining length of time prior to expiration of the set time.

Figure 2:
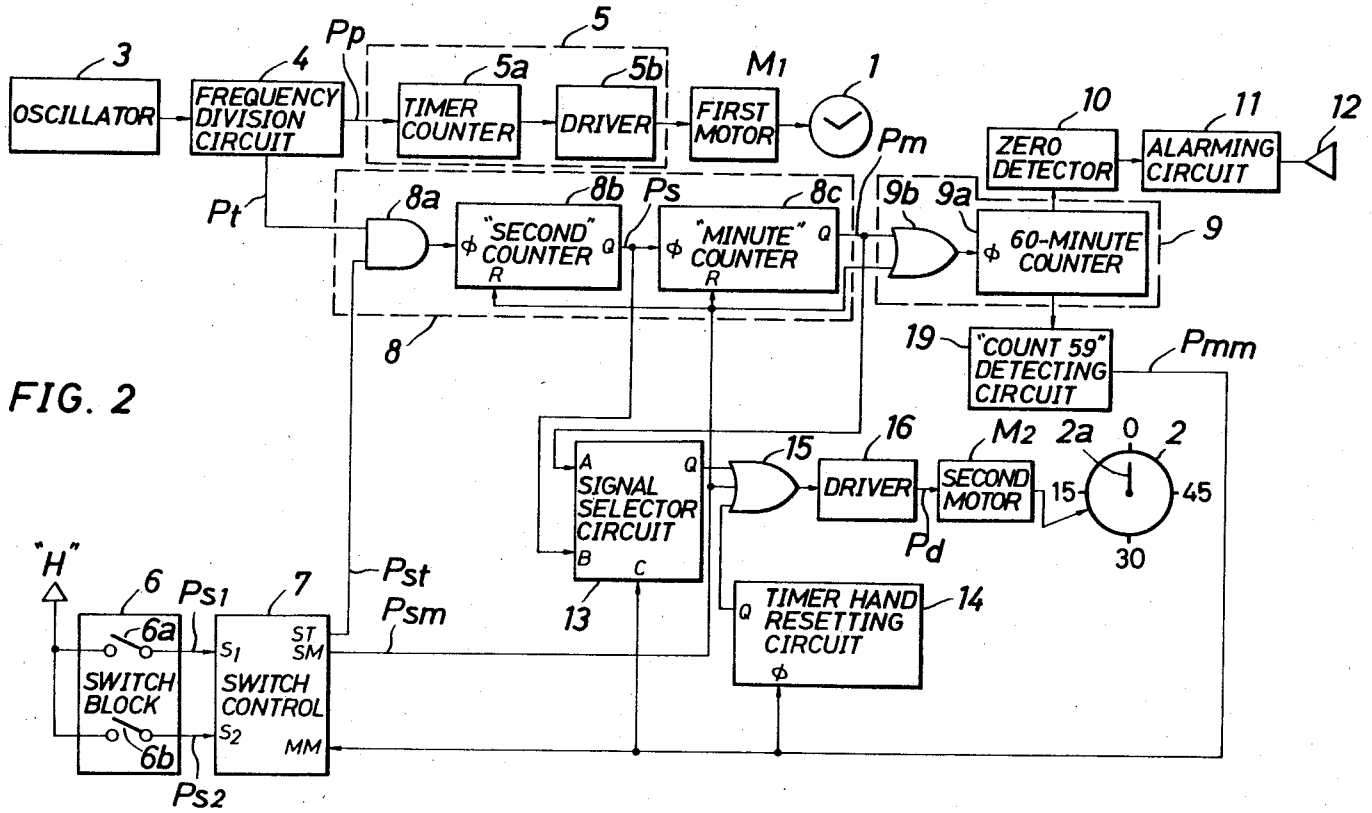
FIG. 2 is a block diagram of the electronic watch of FIG. 1 which is improved according to this invention.

FIG. 2 shows a block diagram of an electronic watch 100 equipped with a timer improved according to this invention.

In FIG. 2, an oscillator 3 for generating a reference signal is connected to a frequency division circuit 4, which is designed to provide a timer reference signal Pt of 50 hertz, and at the same time, a watch reference signal Pp by dividing the reference signal from the oscillator 3. The frequency division circuit 4 is connected to a time measuring circuit 5, which is composed of a time counter 5*a* and a driver 5*b*. The time measuring circuit 5 is connected to a first motor $M_1$ for driving the hour and minute hands on the face 1 of the watch. In operation, the time counter 5*a* divides the watch reference signal Pp, and the signal appearing at the output terminal of the time counter 5*a* is supplied to the first motor $M_1$ via the driver 5*b* to bring the hour and minute hands to the position in which these hands show present time. A switch block 6 includes a start-and-stop switch 6*a* (hereinafter abbreviated "SS switch") and a setting switch 6*b*. These switches 6*a* and 6*b* when turned "on" will provide switch signals Ps1 and by pushing down the "SS button" 102 and the setting button 103 $P_{S2}$ at "H" level. A switch control 7 is responsive to the switch signals Ps1 and $P_{S2}$ applied to its input terminals $S_1$ and $S_2$, respectively, for providing a timer actuation signal Pst at its output terminal ST. Also, the switch control 7 provides, at its output terminal SM, a setting signal Psm for the purpose of setting the timer a given length of time, provided that no signal is applied to its condition input terminal MM. A generator 8 for generating unit signals for the timer, is composed of an AND gate 8*a*, a "second" counter 8*b* and a "minute" counter 8*c*. A timer counter 9 is composed of a 60-minute counter 9*a* and an OR gate 9*b*. So long as a timer actuation signal Pst from the switch control 7 is applied to the AND gate 8*a*, the AND gate 8*a* allows a timer reference signal Pt from the frequency division circuit 4 to pass therethrough. The "second" counter 8*b* functions as a high-rated timer unit signal generator, counting timer reference signals applied to its input terminal $\phi$ to provide "second" signals Ps (high-rated timer unit signals) at its output terminal Q. The "minute" counter 8*c* functioning as a normal-rated timer unit signal generator, counts "second" signals Ps supplied to its input terminal $\phi$ to provide "minute" signals Pm (normally-rated timer unit signal) at its output terminal Q. Then, the "minute" signals Pm are supplied to the 60-minute counter 9*a* via the OR gate 9*b*. The 60-minute counter 9*a* which is composed of an up-counter counts "minute" signals Pm when applied to its input terminal $\phi$ thus performing counting-down until its content is reduced to zero.

In setting the timer, as many setting pulse signals Psm as required for setting the timer for a desired length of time, are supplied to the 60-minute counter 9*a* via the OR gate 9*b* to be registered in the form of complementary number 60 in the 60-minute counter 9*a*. On the other hand, these setting pulse signals Psm are supplied to the timer to drive its hand 2a counterclockwise step by step in pace with the registration in the 60-minute counter 9a as later described in more detail. Thus, when the registration in the 60-minute counter is finished, the hand 2a is brought to a corresponding position on the indicating dial of the timer.

In operation, the timer starts, allowing the 60-minute counter 9a to increase its content until an associated zero detector 10 detects that the content of the 60-minute counter 9a is zero, and then the zero detector 10 supplies to time-up signal to an alarming circuit 11. A buzzer 12 is responsive to the time-up signal for generating an alarming sound.

In the course of counting-up, a "count 59" detecting circuit 19 detects the counting up to "59" in the 60-minute counter 9a, providing a "second" mode shifting signal Pmm at the output terminal of the detector 19 while the content of the counter 9a remains at count "59". A signal selector circuit 13 is responsive to the "second" mode shifting signal Pmm supplied by the "count 59" detecting circuit 19 to the input terminal C of the signal selector 13 for switching its state from the one in which the "minute" signal Pm supplied by the "minute" counter 8c to the input terminal "A" of the selector is allowed to appear at the output terminal Q of the selector to the other in which the "second" signal Ps supplied by the "second" counter 8b to the input terminal B of the selector is allowed to appear at the output terminal Q of the selector.

A timer hand resetting circuit 14 is responsive to the "second" mode shifting signal Pmm supplied to the input terminal of the timer hand resetting circuit for providing one hand resetting pulse Pho at its output terminal. A driver circuit 16, which is connected to the OR gate 15, is responsive to the signal supplied by the selector 13, the hand resetting pulse Pho supplied by the timer hand resetting circuit 14, or the setting signal Psm from the selector 7 for providing motor driving signal Pd at its output terminal. A timer motor $M_2$ is responsive to the motor driving signal Pd from the driver 16 for driving the hand 2a of the timer 2.

Figure 3:
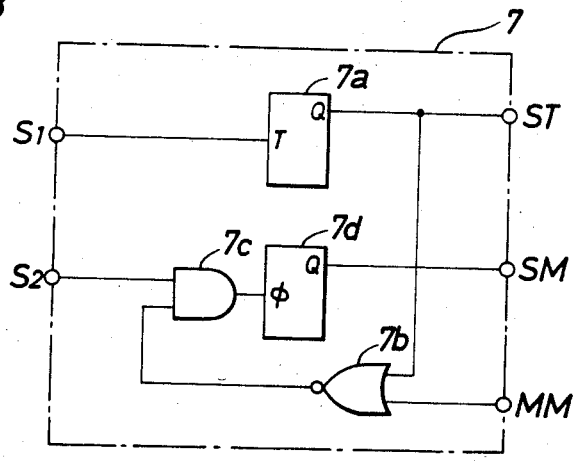
FIG. 3 is a wiring diagram of a switch control appearing in FIG. 2.

FIG. 3 shows a wiring diagram of the switch control 7.

A toggle type flip-flop circuit 7a (hereinafter abbreviated "T.FF") is connected at its input terminal "T" to the input terminal $S_1$ of the switch control 7 and at its output terminal "Q" to the output terminal St of the switch control 7. A NOR gate 7b is connected at its input terminals to the output terminal Q of the T.FF 7a and to the condition input terminal MM of the switch control 7. An AND gate 7c is connected at its input terminals to the output terminal of the NOR gate 7b and to the input terminal $S_2$ of the switch control 7. Finally, a one-shot circuit 7d is connected at its input terminal $\phi$ to the output terminal of the AND gate 7c, and at its output terminal Q to the output terminal SM of the switch control 7.

Now, the operation of the switch control 7 is described below.

In the initial condition in which no signal is supplied to the input terminals $S_1$ and $S_2$ and the condition input terminal MM of the switch control 7, the output terminals Q of the T.FF 7a and the one-shot circuit 7d remain at level "L", and therefore the output terminal of the NOR gate 7b remains at level "H". Then, the AND gate 7c is ready to allow an input signal from the terminal $S_2$ of the switch control 7 to pass to the one-shot circuit 7d. Assume that in the initial condition a switch signal $P_{S2}$ is supplied to the input terminal $S_2$ passes to the one-shot circuit 7d through the AND gate 7c, and then the one-shot circuit 7d provides a pulse in synchronism with the switch signal Ps2. The pulse signal thus appearing at the output terminal SM of the switch control 7 is used as a setting signal Psm.

Assume that a switch signal $P_{S1}$ is applied to the input terminal $S_1$ of the switch control 7. Then, the output terminal Q of the T.FF 7a is brought to level "H", providing a start signal Pst at the output terminal ST of the switch control 7. Assume that another switch signal $P_{S1}$ is applied to the input terminal $S_1$ of the switch control 7. Then, the output terminal Q of the T.FF 7a returns to level "L", thus causing the start signal Pst appearing at the output terminal ST of the switch control 7 to end. In brief, the T.FF 7a reverses its state every time a switch signal $P_{S1}$ is supplied to the input terminal $S_1$ of the switch control 7, causing the start signal Pst to appear and disappear at the output terminal of the switch control 7 alternately and repeatedly.

When the output terminal Q of the T.FF 7a is brought to level "H", the output terminal of the NOR gate 7b is brought to level "L", thus causing the AND gate 7c to prevent the switch signal $P_{S2}$ if applied to input terminal $S_2$ of the switch control 7 from passing to the output terminal SM of the switch control 7. Then, no setting signal Psm appears at the output terminal SM of the switch control 7.

Also, the application of a "second" mode signal Pmm to the input terminal MM of the switch control 7 will cause the AND gate 7c to close, thus not providing a setting signal Psm at the output terminal SM of the switch control 7, either.

Now, the operation of the electronic watch is described below.

The reference signal supplied by the oscillator 3 is divided by the frequency division circuit 4 all the time, and the so divided signal Pp is supplied to the time measuring circuit 5 as the watch reference signal, which is divided by the time counter 5a, and is used to drive the motor $M_1$ via the driver 5b, thereby showing time in the face 1 of the watch.

Next, the operation of the timer is described.

In the initial condition in which the timer is not used, the SS button 102 and the setting button 103 are not pushed, and therefore the SS switch 6a and the setting switch 6b remain off. Accordingly, no input signals are applied to the input terminals $S_1$ and $S_2$ of the switch control 7, thus causing start signal Pst to appear at the output terminal ST of the switch control 7. Therefore, the AND gate 8a, which is connected to the output terminal St of the switch control 7, is not ready to allow the timer reference signal Pt from the frequency divider 4 to pass to the "second" counter 8b.

At the termination of the previous working of the timer the content of the 60-minute counter 9a is zero, and the hand 2a in the round numbered indicating dial of the timer is brought to position "0". Then, no "second" mode signal Pmm is supplied by the "count 59" detecting circuit 19 because the content of the 60-minute counter 9a is zero.

At first, the timer circuit is in the initial condition just described. Then, the timer can be set as follows:

First, the setting button 103 is repeatedly pushed to cause the setting switch 6b of the switch block 6 to turn "on" and "off". As many switch signals Ps2 as the setting button is pushed are supplied to the input terminal $S_2$ of the switch control 7. In the initial condition of the switch control 7, no timer actuation signal Pst appears at the output terminal ST of the switch control 7 (this being called "timer stopping condition"), and no second mode signals Pmm is applied to the condition input terminal MM of the switch control because the content of the 60-minute counter is not 59. In this condition as many setting signals Psm as switch signals Ps2 applied to the input terminal $S_2$ of the switch control 7, are supplied from the output terminal SM of the switch control 7 to the 60-minute counter 9*a* via the OR gate 9*b*, and at the same time, to the driver 16 via the OR gate 15. Thus, the setting signals Psm are counted in the 60-minute counter 9*a*, and at the same time, the setting signals Psm are converted to the motor driving signals Pd for driving the second motor $M_2$, thereby casing the hand 2*a* of the timer 2 to move step by step.

A person wearing the electronic watch can set time as desired simply by repeatedly pushing the setting button 103 while watching the hand 2*a* move step by step. For instance, if the person wants to measure the remaining length of time in watching a soccer match, he advances the hand 2*a* 15 minutes clockwise for the half of the match by pushing the setting button 103 fifteen times, thus bringing the hand 2*a* in the timer to the 3 o'clock position, that is, the position indicated at number 45.

The subsequent operation of the timer thus set is described below. When the SS button 102 is pushed only one time, the SS switch 6*a* of the switch block 6 turns "on", outputting the switch signal $P_{S1}$. When the switch signal Ps1 is supplied to the input terminal $S_1$ of the switch control 7, a timer actuation signal Pst appears at the output put terminal ST of the switch control 7. Application of the timer actuation signal Pst to the AND gate 8*a* brings the gate to the state in which the gate to the state in which the gate is ready to allow the timer reference signal Pt to pass to the "second" counter 8*b*, thus starting the operation of the timer. The timer reference signal Pt is divided in the "second" counter 8*b* to cause the "second" signal Ps to appear at the output terminal Q of the "second" counter 8*b*. The "second" signal Ps is supplied to the input terminal of the "minute" counter 8*c*, and is divided therein to provide the "minute" signal Pm at the output terminal Q of the "minute" counter 8*c*. The "minute" signal Pm is supplied to the input terminal of the 60-minute counter 9*a* to advance one step per minute in the counting-up direction. On the other hand, the selector circuit 13 is in the state in which the signal applied to the input terminal A of the selector 13 is allowed to pass to the output terminal Q. Thus, the timer unit signal, that is, the "minute" signal Pm appears at the output terminal Q of the selector 13, and then the "minute" signal Pm is supplied to the driver 16 via the OR gate 15. The driver 16 supplies one-minute period motor driving signals Pd to the motor $M_2$ in synchronism with the "minute" signal Pm to drive the hand 2*a* of the timer clockwise. Thus, the number of the steps taken by the hand 2*a* corresponds to the content of the 60-minute counter 9*a*. Both of the timer and the 60-minute counter advance one step per minute in the counting up mode.

The sequence just described is called "minute mode" or normal mode of the timer using normally-rated timer unit signals. The "minute mode" continues until the remaining length of set time is one minute long.

Now, "expanding time presentation mode" using high-rated timer unit signals is described.

When the remaining length of time is one minute long in the "minute mode" (the content of the 60-minute counter 9*a* being equal to 59, and the hand 2*a* having advanced 44 steps to indicate one minute-long time left), the 59 count detecting circuit 19 detects that the 60-minute counter 9*a* counts 59 up and a "second" mode shifting signal Pmm appears at the output terminal of the detector 19. The timer hand resetting circuit 14 outputs only one hand resetting pulse Pho in response to the "second" mode shifting signal Pmm, and then the resetting pulse Pho is supplied to the driver 16 via the OR gate 15, thereby causing the motor $M_2$ to advance one step, and hence bringing the hand 2*a* from the "one minute left" position in which one minute is left to the expiration of set time to the zero position in which the hand 2*a* indicates zero.

On the other hand, the application of the "second" mode shifting signal Pmm to the input terminal C of the selector circuit 13 causes the selector 13 to change its state to the one in which the selector is ready to allow any signals applied to its input terminal B to pass to its output terminal Q. Thus, the high-rated timer unit signal or "second" signal Ps applied to the input terminal B of the selector appears at the output signal Q of the selector in place of the timer unit signal or "minute" signal Pm which are applied to the input terminal A of the selector. The high-rated timer unit signal or "second" signal Ps is supplied to the driver 16 via the OR gate 15. Then, the driver 16 supplies one-second period motor driving signal Pd to the motor $M_2$, thereby driving the hand 2*a* step by step. Thus, the timer is switched from the "minute" mode to the "second" mode in which the hand 2*a* advances at the rate of one step per second. In this particular embodiment the expanding time display mode is the one in which the hand moves as the second hand under the control of the high-rated timer unit signal or "second" signal Ps.

The "second" mode will end when the content of the 60-minute counter 9*a* is reduced to zero, and when the hand 2*a* returns to zero position after completing one revolution, and at the same time, the timer operation ends. When the content of the 60-minute counter 9*a* is zero, the zero detector circuit 10 generates a time-up signal to supply the same to the alarming circuit 11. The alarming circuit 11 supplies the alarm signal to the buzzer 12 for informing the person of the expiration of the set time.

In brief, the timer in the embodiment just described permits the advance of the hand at the rate of one step per minute before the set time has one minute left, and then the advance of the hand at the rate of one step per second for the remaining period of one minute. The former is hereinbefore called "minute" mode, and the latter is called "second" mode. The "minute" mode is useful in permitting extension of maximum setting length of time, whereas the "second" mode is useful in increasing the resolution with which time is shown just prior to the expiration of the set time. As described above, if the timer is used in showing time for the half of soccer match 45 minutes long, the timer works in the "minute" mode for the first 44 minute-long period, and then the timer works in the "second" mode for the final 1 minute-long period for which a most exciting tide of events is liable to take place.

Next, the way of interrupting and resuming the operation of timer is described, taking an example of a soccer match again.

Assume that a player is happened to get hurt, and that the proceeding of time is made to cease.

The interrupting and resuming mode of the timer is as follows:

While the timer works, the SS switch 6*a* is made to turn "on" to provide a switch signal Ps1 to the input terminals $S_1$ of the switch control 7. Then, the timer actuation signal Pst disappears at the output terminal ST of the switch control 7, thus causing the AND gate 8*a* to close and prevent the passage of the timer reference signal Pt therethrough. Thus, the timer counter 9 stops, and at the same time, the timer stops. The operation of the SS button 102, however, will cause the timer to resume its advance. Thus, the timer can be interrupted and resumed alternately every time the SS button 102 is operated. This is the same both with the "minute" mode and the "second" mode.

Specifically, no matter in which mode the timer works, a person pushes the button SS 102 once to interrupt the motion of the timer when occasions demand, and he pushes the button SS 102 again to allow the timer to measure and show the remaining length of set time.

Next, the way of changing the length of time once set while the timer is working, is described below.

When a person wants to reset the timer while the timer is running in the "minute" mode, he pushes the SS button 102 to stop the timer. Then, he pushes the setting button 103 as many times as required for setting the 60-minute counter 9*a* and the hand 2*a* of the timer for a desired length of time. Then, the setting signal Psm resets the "second" counter 8*b* and the "minute" counter 8*c*.

In this particular embodiment the maximum setting length of time is equal to 60 minutes, and the final one minute is measured and shown in an expanded scale of second. It, however, should not be understood that this is limitative. Any maximum setting length of time can be adopted to meet the need, and the final two or three minutes or only a part of the final one minute can be measured and shown in an expanded scale.

As is apparent from the above, the analogue type timer according to this invention permits the selection of working modes, that is, normal mode effected by means of normally-rated timer unit signal and expansion mode effected by means of high-rated timer unit signal, thus increasing the maximum setting length of time to a possible maximum, and increasing the resolution with which the final part of the set time is measured and shown just prior to the expiration of the set time. In the final part of the half of a soccer match a dramatic change in the tide of events in the match may be expected, and the counting in terms of seconds in the final part of the match will be effective to enhance excitement in watching the match.

What is claimed is:

1. An analogue type timer comprising:

a reference signal generator;

a frequency division circuit for dividing the reference signal from the reference signal generator;

means for generating normally-rated timer unit signal on the basis of the output of said frequency division circuit;

a pulse motor to be driven by the normally-rated timer unit signal;

a hand operatively connected to the pulse motor for moving around the face of the timer;

a timer counter for counting the normally-rated timer unit signals supplied to the pulse motor; and means for setting the timer for a desired length of time characterized in that it further comprises:

means for generating a high-rated timer unit signal which is shorter in period than the normally-rated timer unit signal;

means for detecting the point of time when the content of the timer counter corresponds to a predetermined remaining length of time; and means responsive to the output signal from said detecting means for supplying, in place of the normally-rated timer unit signal, the high-rated timer unit signal to the pulse motor, whereby the hand of the timer is allowed to advance step by step under the control of the normally-rated timer unit signal over the major part of the length of set time on the indicating dial of the timer whereas the hand of the timer is allowed to advance one round of the indicating dial of the timer for every step of advance over the remaining predetermined length of set time under the control of the high-rated timer unit signal, instead of step by step advance under the control of the normally-rated timer unit sinal.

2. An analogue type timer according to claim 1, wherein the high-rated timer unit signal has a frequency of the frequency of the normally-rated timer unit signal multiplied by the number of the steps of one round of the indicating dial of the timer.

3. An analogue type timer according to claim 1, wherein the normally-rated timer unit signal has a period of one minute whereas the high-rated timer unit signal has a period of one second.

4. An analogue type timer according to claim 3, wherein the high-rated timer unit signal generator comprises a "second" counter responsive to the signal from the frequency division circuit for generating a high-rated timer unit signal of one second period, whereas the normally-rated timer unit signal generator comprises a "minute" counter responsive to the signal from the "second" counter for generating a normally-rated timer unit signal of one minute period.

5. An analogue type timer according to claim 1, wherein it further comprises a hand resetting circuit for resetting the hand of the timer at the time of switching the timer from the normal stepping mode to the high-rated stepping mode.

6. An analogue type timer according to claim 5, wherein the hand resetting circuit is designed to bring the hand of the timer to the starting point (or zero position) prior to the shift to the high-rated stepping mode.

7. An analogue type timer according to claim 1, wherein the timer counter is composed of a 60-minute counter, and the detecting means connected to the timer counter is composed of a 59-minute detecting circuit for detecting the point of time when the timer coutner has counted down 59.

* * * * *